US005930583A

United States Patent [19]

Yasue et al.

[11] Patent Number: 5,930,583

[45] Date of Patent: Jul. 27, 1999

[54] METHOD FOR FORMING TITANIUM ALLOYS BY POWDER METALLURGY

[75] Inventors: Kazuo Yasue; Gongli Yu, both of Aichi, Japan

[73] Assignee: Japan as represented by Director General of Agency of Industrial Science and Technology, Tokyo, Japan

[21] Appl. No.: 08/916,957

[22] Filed: Aug. 25, 1997

[30] Foreign Application Priority Data

Aug. 27, 1996 [JP] Japan ..... 8-244110

[51] Int. Cl.[6] ..... B22F 3/12

[52] U.S. Cl. ..... 419/38; 419/39; 419/46; 419/47; 419/54; 419/57; 419/60

[58] Field of Search ..... 419/46, 47, 38, 419/39, 54, 57, 60

[56] References Cited

U.S. PATENT DOCUMENTS

| | | | |
|---|---|---|---|
| 3,950,165 | 4/1976 | Oda et al. | 75/200 |
| 3,950,166 | 4/1976 | Obara et al. | 75/213 |
| 4,381,942 | 5/1983 | Blum et al. | 419/23 |
| 4,432,795 | 2/1984 | Andersen | 75/245 |
| 4,719,077 | 1/1988 | Suzuki et al. | 419/23 |
| 4,917,858 | 4/1990 | Eylon et al. | 419/28 |
| 5,306,569 | 4/1994 | Hiraki | 428/569 |
| 5,422,069 | 6/1995 | Perfect | 419/45 |
| 5,701,575 | 12/1997 | Taguchi et al. | 419/28 |

OTHER PUBLICATIONS

Masuo Hagiwara, et al. "Manufacture and Mechanical Properties of Blended Elemental P/M Titanium Alloys", vol. 75 (1989), pp. 221–227 (With partial English Translation).

R.M.K. Young, et al. "A Powder–Based Approach to Semi-solid Processing of Metals for Fabrication of Die–Castings and Composites", Journal of Materials Science, vol. 21, (1986), pp. 1057–1069.

D.H. Kirkwood, "Semisolid Metal Processing", International Materials Reviews, vol.39, No. 5, (1994), pp. 173–189.

*Primary Examiner*—Daniel J. Jenkins

*Attorney, Agent, or Firm*—Oblon, Spivak, McClelland, Maier & Neustadt, P.C.

[57] ABSTRACT

This invention relates to a method for forming a titanium alloy by powder metallurgy, which comprises the processes of mixing uniformly a powder of titanium or an alloy thereof with a low-melting point metal or alloy powder, injecting the mixture into a press forming die, then press forming them under heating to a temperature near and over the melting point of the low-melting point metal, or to a temperature between the liquidus and the solidus of the low-melting point alloy, or to a temperature near and over the liquidus to obtain the targeted compact, and holding this compact in the pressurized state to cause the molten low-melting point metal or alloy to infiltrate the powder grain boundary of the titanium or alloy thereof, and then sintering the compact thus obtained in an inert atmosphere or a vacuum to diffuse the titanium or alloy thereof and the low-melting point metal or alloy into each other and to make alloys of them.

12 Claims, 2 Drawing Sheets

METHOD FOR FORMING TITANIUM ALLOYS BY POWDER METALLURGY

DESCRIPTION OF THE INVENTION

This invention relates to a method for forming a titanium alloy by powder metallurgy, and more particularly relates to a method by which a high-density sintered body of a titanium alloy with a complex shape can be formed at a low cost.

BACKGROUND OF THE INVENTION

Various processes have been studied in the past as powder metallurgy methods for titanium alloys, and many of these have been subjected to practical application. These processes are categorized by the type of powder raw materials used, and by the type of forming process used in obtaining a compact from these raw materials. Specifically, depending on the powder raw materials used, these processes are broadly grouped into blended elemental method and prealloyed method, and depending on the forming process employed, these processes are classified into die forming method, hydrostatic pressure forming method, injection molding method and so on.

First, of the processes broadly grouped by the powder raw materials used, the blended elemental method involves the use of a mixed powder obtained by mixing specific proportions of pure titanium powder and a metal powder used for adding the alloy element, namely a powder of the metal that is added as the alloy element to the pure titanium powder, as the powder raw material. The prealloyed method, which is the other type of method, involves the use of an alloy powder that has already been alloyed as the powder raw material.

Meanwhile, of the classifications by the forming process used in obtaining a compact from the powder raw materials, a die forming method involves obtaining the targeted compact by injecting the above-mentioned mixed powder raw material or alloy powder raw material into a specific die, with a small amount of lubricating oil added, and then press forming the contents. In a hydrostatic pressure forming method, a mold that is sufficiently flexuous, composed of rubber, plastic or the like, is used as the mold, the inside of which is packed with the powder raw material, after which the inside of the mold is vacuum evacuated and sealed in this state, and then the sealed mold is subjected to hydrostatic pressure to form a compact. Finally, an injection molding method is a process in which a mixture obtained by mixing a powder raw material with a large quantity of binder and a lubricating oil or the like is extruded inside a specific mold, and then heated to decompose and remove the binder, which yields a compact.

A compact obtained by one of the above forming methods from a mixed powder raw material or alloy powder raw material is sintered by being further heated in a vacuum or in an inert atmosphere, and in a blended elemental method, the various elemental powder components contained in the mixed powder raw material are diffused and alloyed, thus yielding a targeted sintered body of the titanium alloy.

These various powder metallurgy methods for titanium alloys each have their own distinctive advantages, as will be discussed below, but they also have drawbacks. For instance, advantages to a blended elemental method are that because relatively soft pure titanium is used, the forming is easy, and the material cost is lower than with a prealloyed method in which an expensive alloy powder is used, but a drawback is that in the event that the mutual diffusion coefficient of titanium is different from that of the metal used for the alloy element, the Kirkendall effect causes the sintered body to be prone to cavity formation in the sintering and alloying process. Also, in the event that the melting points of the titanium and the metal used for the alloy element are markedly different, first of all, when the metal with the lower melting point is melted, the compact will expand and cracks will develop in it, or the molten metal will infiltrate the grain boundary and form cavities, or this molten metal will react with the titanium to form a brittle intermetallic compound. As a result, there is the problem of a marked decrease in the strength of the sintered body obtained.

In a die forming method, an advantage is a lower processing cost than in other forming methods, but on the other hand, because the pressing during forming is only performed in one direction (the press direction of the die), in order for a uniform pressure to act on the entire powder raw material, the particles that make up the powder raw material must be capable of moving easily as a result of the local pressure differential within the die, but in actual practice, friction between the die and the powder raw material or between the particles of the powder raw material precludes sufficient movement of the particles of the powder raw material during press forming, and as a consequence, particularly when the targeted compact has a complex shape, it is impossible to apply the pressure uniformly to the powder raw material, and in turn to the compact. Therefore, in the case of a compact with a complex shape, excessive shear stress can occur locally, and this can cause shear cracking to occur. Also, it is geometrically advantageous to use a powder raw material with a finer particle size in order to raise the density of the compact with a die forming method, but the finer is the particle size of the powder raw material, the greater is the above-mentioned friction between the particles of the powder raw material and so on, so there is a limit to how much the density of the compact, and in turn that of the sintered body obtained from this compact, can be increased with a die forming method.

Furthermore, with a hydrostatic pressure forming method, because a sufficiently flexuous mold composed of rubber, plastic or the like is used, and because the hydrostatic pressure is applied to this mold in a state in which the mold has been pressed tightly against the powder raw material by vacuum suction, the pressure can be applied almost evenly to the entire surface of the mold that surrounds the powder raw material even if the targeted compact has a complex shape, so a compact with a complex shape can be obtained. On the other hand, with this method, processes for preparing the mold, the vacuum suction, the tight pressing of the mold and the application of the hydrostatic pressure and so on are required, which causes a problem in that it makes the forming process more complicated and drives up the processing costs.

With an injection molding method, a mixed powder raw material or an alloy powder raw material is used in a state in which it is mixed with a large quantity of binder and a lubricating oil or the like, so this powder raw material has high fluidity, and sufficient movement can be obtained for the particles of the powder raw material during press molding, which means that the pressure can be applied almost evenly to the powder raw material, and in turn to the compact, even when the targeted compact has a complex shape. As a result, a feature of this method is that a compact with a complex shape can be obtained, but the down side to an injection molding method is that the above-mentioned binder removal step takes about half a day at a temperature of several hundred degrees, and an expensive powder raw material having a particle size of no more than a few dozen microns is required, so processing costs and raw material costs are disadvantages. Also, since this binder removal is completed in a state in which a small amount of binder is left in the compact in order to preserve the shape of said compact in the sintering step, with a highly active metal such as titanium, this binder forms carbides and oxides with the titanium in the sintering step, and this can result in a loss of strength and other such characteristics of the sintered body obtained. Furthermore, it is difficult to remove the binder uniformly if the depth of the targeted compact are thick, and even if the binder is removed under ideal conditions for the surface layer of said compact, a large amount of binder will still be left behind in the interior thereof, which leads to the above-mentioned deterioration in characteristics and to serious deformation during sintering. As a result, the size of the compact to which an injection molding method can be applied is limited to compacts weighing a few dozen grams at most.

SUMMARY OF THE INVENTION

The object of this invention is to provide a method for form ing a titanium alloy by powder metallurgy, which can be applied at a low cost even when the shape of the targeted sintered body is complex, and furthermore, with which a sintered body of almost true density can be formed.

This invention relates to a method for forming a titanium alloy by powder metallurgy, which comprises the processes of mixing uniformly a powder of titanium or an alloy thereof with a low-melting point metal or alloy powder, injecting the mixture into a press forming die, then press forming them under heating to a temperature near and over the melting point of the low-melting point metal, or to a temperature between the liquidus and the solidus of the low-melting point alloy, or to a temperature near and over the liquidus to obtain the targeted compact, and holding this compact in the pressurized state to cause the molten low-melting point metal or alloy to infiltrate the powder grain boundary of the titanium or alloy thereof, and then sintering the compact thus obtained in an inert atmosphere or a vacuum to diffuse the titanium or alloy thereof and the low-melting point metal or alloy into each other and to make alloys of them.

DETAILED DESCRIPTION OF THE INVENTION

The present invention was conceived in the midst of this situation, and the object thereof is to provide a method for forming a titanium alloy by powder metallurgy, which can be applied at a low cost even when the shape of the targeted sintered body is complex, and furthermore, with which a sintered body of almost true density can be formed.

As a result of painstaking research aimed at achieving this object, the inventors arrived at the present invention upon discovering that even when a die forming method is employed and a mixture of titanium or an alloy powder thereof and a low-melting point metal or alloy powder is used as the powder raw material, the above problems encountered with blended elemental method and die forming method can be completely solved by press-forming the mixture at a temperature near and over the melting point of said low-melting point metal, or at a temperature between the liquidus and the solidus of said low-melting point alloy, or at a temperature near and over the liquidus, and that this, combined with the advantages inherent to blended elemental method and die forming method, allows the above-mentioned object to be achieved advantageously.

Specifically, the method for forming a titanium alloy by powder metallurgy pertaining to the present invention is characterized in comprising the processes of mixing uniformly a powder of titanium or an alloy thereof with a low-melting point metal or alloy powder, injecting the mixture into a press forming die, then press forming them under heating to a temperature near and over the melting point of the low-melting point metal, or to a temperature between the liquidus and the solidus of the low-melting point alloy, or to a temperature near and over the liquidus to obtain the targeted compact, and holding this compact in the pressurized state to cause the molten low-melting point metal or alloy to infiltrate the powder grain boundary of the titanium or alloy thereof, and then sintering the compact thus obtained in an inert atmosphere or a vacuum to diffuse the titanium or alloy thereof and the low-melting point metal or alloy into each other and to make alloys of them.

With the method for forming a titanium alloy by powder metallurgy pertaining to the present invention, the powder raw material composed of a powder of titanium or an alloy thereof and a low-melting point metal or alloy powder is heated to a temperature near and over the melting point of the low-melting point metal, or to a temperature between the liquidus and the solidus of the low-melting point alloy, or to a temperature near and over the liquidus, and press formed, so the low-melting point metal or alloy contained in said powder raw material melts at least partially and acts as a lubricant, which suppresses friction between the die and the powder raw material or between the particles of the powder raw material, while imparting fluidity to the powder raw material, and this allows for sufficient movement of the particles of the powder raw material during press forming. Therefore, even if the targeted compact has a complex shape, it is possible to apply the forming pressure almost evenly to the powder raw material, and in turn to the compact. Also, the occurrence of excessive local shear stress is effectively prevented, which allows for the easy forming of a compact with a complex shape, with no shear cracking, and with a almost uniform density distribution.

Also, with this method for forming a titanium alloy by powder metallurgy of the present invention, the compact is held in a pressurized state to cause the above-mentioned molten low-melting point metal or alloy to infiltrate the powder grain boundary of the above-mentioned titanium or alloy thereof, which effectively inhibits the above-mentioned cracking of the compact caused by the prior melting and expansion of the low-melting point metal or alloy, the formation of cavities caused by the out-flow of the molten low-melting point metal or alloy, and the formation of brittle intermetallic compounds caused by a reaction between the molten low-melting point metal or alloy and the titanium or alloy thereof, which can all occur during the sintering of said compact, and this allows a sintered body with high strength and almost true density to be obtained.

In addition, since the method for forming a titanium alloy by powder metallurgy of the present invention is based on a blended elemental method and a die forming method, a relatively coarse, inexpensive powder raw material can be used, and there is no need for complicated steps in which a rubber or plastic mold is prepared, vacuum suction and sealing are performed, hydrostatic pressure is applied and so on, so the material costs and processing costs can be reduced. Moreover, since no binder whatsoever is used, there are no limitations on the size of the compact (such as its thickness), and no deterioration in the strength and other characteristics as a result of residual binder, nor is there is any need for a binder removal step or the like, so the processing costs can be reduced even further.

Besides the above, with the method for forming a titanium alloy by powder metallurgy of the present invention, since the forming of the compact to be obtained is performed in the atmosphere, as discussed below, there is no need for any special atmosphere adjustment or the like for the processing of titanium metal, which is a highly active metal, which means that the process is easier to control and that productivity is enhanced.

Therefore, the method for forming a titanium alloy by powder metallurgy of the present invention allows a titanium alloy sintered body having a complex shape, almost true density, and excellent strength and other such characteristics to be obtained at a low cost.

In the first preferred embodiment of the method of the present invention, the low-melting point metal or alloy is aluminum, tin, or an alloy of these, and as a result, in the sintering process, a good alloy can be formed between this metal or alloy and the titanium or alloy thereof.

In the second preferred embodiment of the method of the present invention, the temperature near and over the melting point or the temperature near and over the liquidus is the melting point or a temperature up to 100° C. over the liquidus, and as a result, the formation of the above-mentioned intermetallic compounds is advantageously prevented at the grain boundary of the titanium or alloy thereof.

In the third preferred embodiment of the method of the present invention, the compact is held in a pressurized state for at least 10 minutes at a pressure of 10 to 500 MPa, and as a result, the low-melting point metal or alloy reliably infiltrates the grain boundary of the powder of titanium or an alloy thereof as discussed above.

In the fourth preferred embodiment of the method of the present invention, the compact is sintered for at least 30 minutes at a temperature of at least 1000° C.

Examples of the powder of titanium or an alloy thereof used in the method for forming a titanium alloy by powder metallurgy pertaining to the present invention include sponge titanium, titanium-iron, titanium-vanadium, and other such powders. The "low-melting point metal or alloy powder" that can be used along with this titanium or alloy thereof refers to a powder whose melting point is lower than that of the titanium or titanium alloy being used. Specific examples include aluminum, tin, aluminum-tin alloys, and other alloys of aluminum and of tin, which readily form good alloys with titanium and titanium alloys.

The particle diameter of the titanium or titanium alloy powder and the low-melting point metal or alloy powder should be 50 to 500 μm, with 100 to 300 μm being preferable. The probable reason for this is that if the particle diameter of these powders is smaller than 50 μm, the sintered body that is obtained will be prone to the formation of cavities and will be susceptible to oxidation, and if it is larger than 500 μm, the voids between the powder particles will be to large, which contributes to the formation of cavities in the resulting sintered body.

The above-mentioned titanium or titanium alloy powder and the low-melting point metal or alloy powder are uniformly mixed and made into a mixed powder raw material by a known method, after which the mixture is injected into a specific die for press forming. Next, the mixture is heated to a temperature near and over the melting point of the low-melting point metal, or to a temperature between the liquidus and the solidus of the low-melting point alloy, or to a temperature near and over the liquidus, and press formed under a specific pressure to obtain the targeted compact.

Herein, "a temperature near and over the melting point of the low-melting point metal" means over the melting point of the low-melting point metal and no higher than the temperature that is the upper limit at which the formation of intermetallic compounds between the low-melting point metal and the titanium or titanium alloy can be sufficiently ignored. "A temperature between the liquidus and the solidus of the low-melting point alloy" means a temperature between the value on the solidus and the value on the liquidus in the alloy composition of the low-melting point alloy being used. "A temperature near and over the liquidus of the low-melting point alloy" means at least the value on the liquidus in the alloy composition of the low-melting point alloy being used and no higher than the temperature that is the upper limit at which the formation of intermetallic compounds between the low-melting point metal and the titanium or titanium alloy can be sufficiently ignored, just as above. From the standpoint that the formation of the above-mentioned intermetallic compounds can be advantageously prevented, the preferable range for this temperature near and over the melting point of the low-melting point metal or temperature near and over the liquidus of the low-melting point alloy is the melting point or a temperature up to 100° C. over the liquidus, preferably a temperature up to 50° C., and more preferably a temperature up to 30° C.

The press forming of this mixed powder raw material may be accomplished by heating the mixed powder to a temperature near and over the melting point of the low-melting point metal, or to a temperature between the liquidus and the solidus of the low-melting point alloy, or to a temperature near and over the liquidus, and then pressing this product at the above-mentioned specific pressure, but it may also be accomplished by pressing at the specified pressure while simultaneously heating said mixed powder so that this temperature is reached.

The preferable range for the pressure applied to the mixed powder raw material via the die in the above-mentioned press forming is about 10 to 500 MPa, preferably 50 to 300 MPa. The reason for this is that the forming of the compact will be inadequate if the pressure is lower than 10 MPa, whereas there will be problems with the durability of the die if the pressure is higher than 500 MPa.

The compact obtained in the targeted shape from the mixed powder raw material under the specified heating and pressurization is then held for the length of time discussed below in a constant pressurized state in which the pressure during the forming is maintained, or in a pressurized state in which the pressure is changed as a function of time from the pressure value during forming, which causes the molten low-melting point metal or alloy to infiltrate the powder grain boundary of the above-mentioned titanium or alloy thereof. The duration that this pressurized state is held should be at least 10 minutes, preferably at least 30 minutes and more preferably at least 1 hour. The above range can be employed favorably as the preferable pressure range in this process, and this, combined with employing the above-mentioned preferable duration of the pressurized state, results in the reliable in filtration of the grain boundary of the powder of titanium or an alloy thereof by the low-melting point metal or alloy After this, the compact thus obtained is sintered in argon or another such inert atmosphere or in a vacuum, which diffuses the titanium or alloy thereof and the low-melting point metal or alloy into each other to make alloys of them, and thus yields the targeted titanium alloy sintered body (compact). The temperature during this firing should be at least 1000° C. and preferably at least 1100° C., so that the atoms will be sufficiently diffused in the compact. The sintering duration should be at least 30 minutes, particularly favorably at least 1 hour.

Explanation of the Symbols

Figure 1:
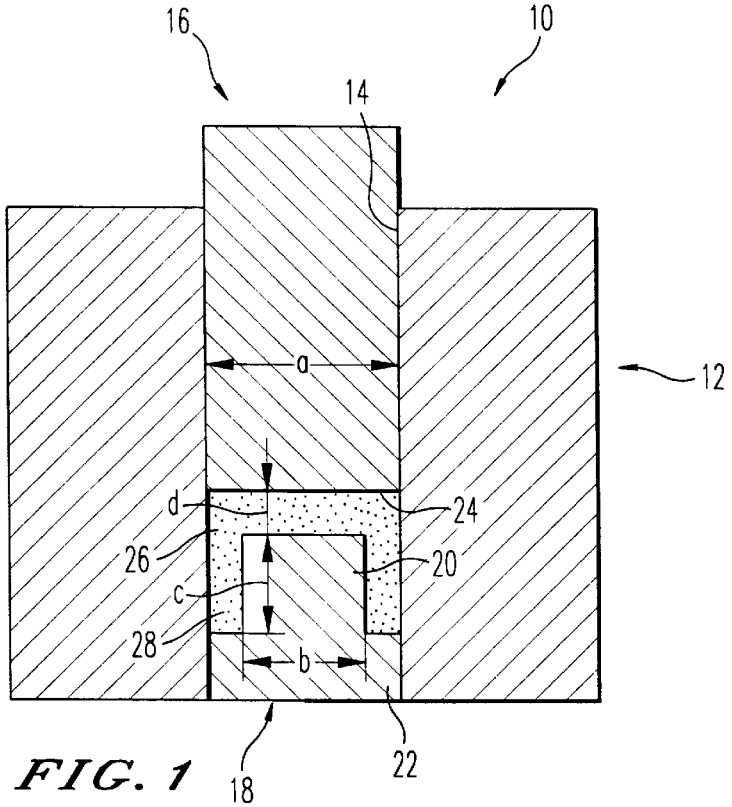
FIG. 1 is a cross section illustrating an example of the die used in the process of forming a titanium alloy sintered body according to the method for forming a titanium alloy by powder metallurgy pertaining to the present invention.

10 die
12 body
14 circular hole
16 upper punch
18 lower punch
20 small diameter portion
22 large diameter portion
24 bottom surface
26 forming cavity
28 mixed powder raw material

EXAMPLES

A number of examples of the present invention will now be given in order to illustrate the present invention in more specific terms, but it goes without saying that the present invention is in no way limited by these examples being given. It should be understood that to the extent that the gist of the present invention is not exceeded, various modifications, adjustments, improvements and the like can be added on the basis of the knowledge of a person skilled in the art in addition to the following examples, and besides the specific description in the embodiments of the above-mentioned invention.

First, 20 g of titanium powder (particle size: 150 $\mu$m) manufactured by gas atomization and 1.2 g of aluminum powder (particle size: 45 $\mu$m) also manufactured by gas atomization were put into a mortar and uniformly mixed to prepare a mixed powder raw material. The alloying of a mixed powder raw material such as this yields an alloy of Ti-6%Al. This product was packed into the forming cavity 26 of a press forming die 10 as shown in FIG. 1.

The press forming die 10 here comprises a body 12 that has a circular hole 14 which passes vertically through the approximate center of the main sides on the top and bottom; a cylindrical upper punch 16 that is slidably inserted into this circular hole 14 from the top in FIG. 1; and a lower punch 18 that is slidably inserted into said circular hole 14 from the bottom in FIG. 1, that is positioned facing and at a specific distance from said upper punch 16, and that has a stepped cylindrical shape that is smaller in diameter at the top. The forming cavity 26, whose shape corresponds to the targeted cup-shaped compact, is formed by the outer peripheral surface of the small diameter portion 20 and large diameter portion 22 of the lower punch 18, the bottom surface of the upper punch 16, and the inner surface of the circular hole 14. The dimensions of the forming cavity 26 are a: 20 mm, b: 14 mm, c: 10 mm, and d: 3 mm.

The mixed powder raw material 28 that was injected inside the forming cavity 26 of the die 10 was placed in a heating furnace, together with the forming die 10, and heated by raising the temperature to a temperature near and over the melting point of aluminum: 670° C. for approximately 30 minutes. After said die 10 reached 670° C., a load of 200 MPa was applied by a hydraulic press (not illustrated) to the mixed powder raw material 28 via the upper and lower punches 16 and 18 of the die 10, and this state was held for the period specified below, which yielded the targeted compact. The holding duration was 120 s, 1.8 ks, 3.6 ks, and 7.2 ks. After this, the compact thus obtained was taken out of the die 10 and sintered for 2 hours under a vacuum of $10^{-5}$ torr at 1200° C., which yielded a cup-shaped sintered body.

Figure 2:
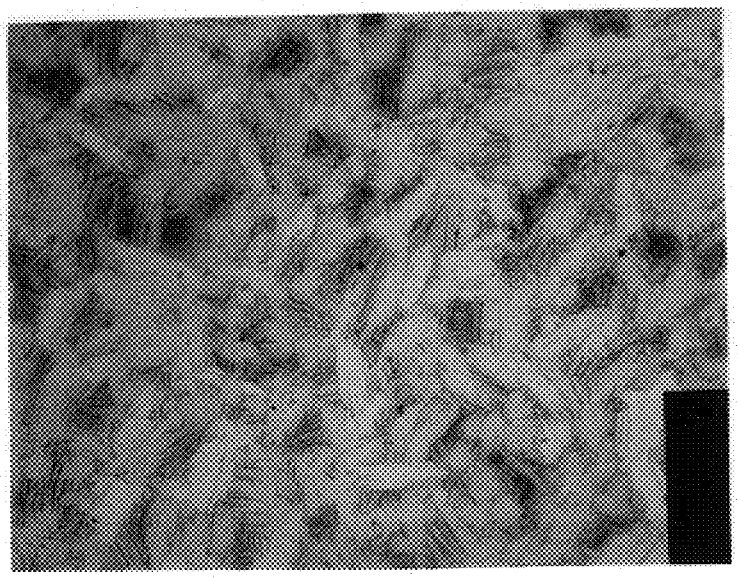
FIG. 2 is an optical micrograph showing the metal texture of sample piece of a titanium alloy sintered body whose pressure holding duration during forming was 120 s, which was formed according to the method for forming a titanium alloy by powder metallurgy pertaining to the present invention.
Figure 3:
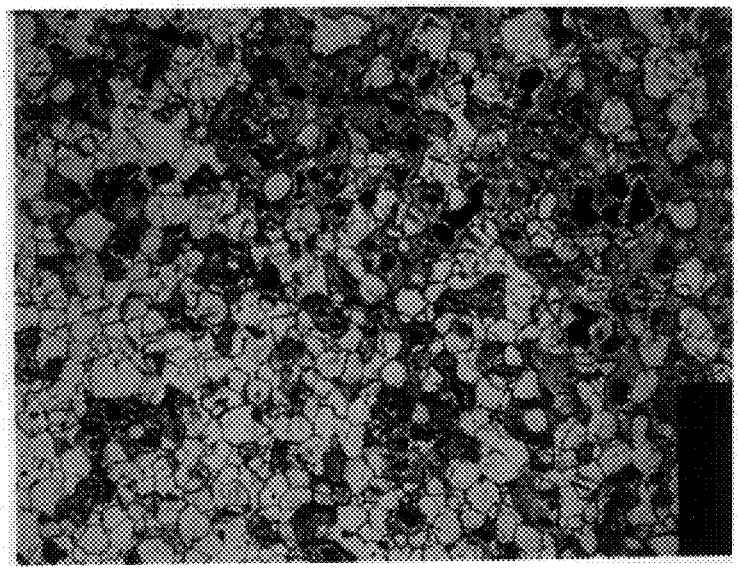
FIG. 3 is an optical micrograph showing the metal texture of sample piece of a titanium alloy sintered body whose pressure holding duration during forming was 7.2 ks, which was formed according to the method for forming a titanium alloy by powder metallurgy pertaining to the present invention.

Of the cup-shaped sintered bodies obtained above, sample pieces were cut out of the bottom portions of the sintered bodies whose pressure holding duration during forming was 120 s and 7.2 ks, and cross sections thereof were observed. FIGS. 2 and 3 are photographs, enlarged 50 times, of the cross sections of the sample pieces from the sintered bodies whose pressure holding duration during forming was 120 s and 7.2 ks. In these figures, the black portions indicate cavities, the white portions indicate the a phase, and the gray portions indicate a lamella texture (stratiform texture) of the a phase and an intermetallic compound ($Ti_3Al$). As is clear from FIG. 2, it was confirmed that when the pressure holding duration during forming was 120 s, numerous cavities remained even in those portions at the bottom of the cup-shaped sintered body, where it is easier to apply the pressure, and the generation of intermetallic compounds was also seen. Meanwhile, as is clear from FIG. 3, when said holding duration was 7.2 ks, the texture was composed completely of a phase, with almost no cavities seen, and it can be seen that almost true density was achieved. Furthermore, although not depicted here, it was confirmed that the tip portions of the cup-shaped sintered body also had this same texture.

Figure 4:
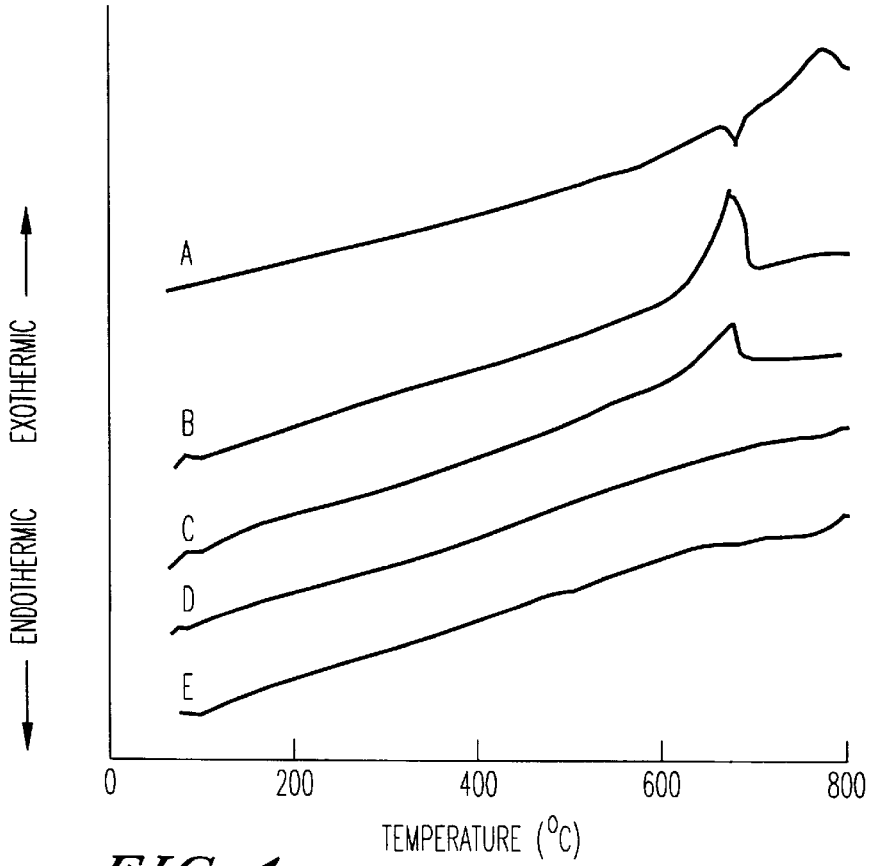
FIG. 4 is a graph of the differential thermal analysis results for the compact samples, and mixed powder raw materials thereof, formed according to the method for forming a titanium alloy by powder metallurgy pertaining to the present invention.

Also, for the sake of further confirmation that the generation of brittle intermetallic compounds can be effectively suppressed by holding the pressure exerted on the compact, the various compacts were analyzed by differential thermal analysis prior to the above-mentioned sintering, the results of which are given in FIG. 4. In this figure, sample A is a mixed powder raw material obtained merely by mixing the same titanium powder and aluminum powder used in the above-mentioned sintered body, and samples B through E are compact samples prior to the above-mentioned sintering, in which the pressure holding duration during forming was 120 s, 1.8 ks, 3.6 ks, and 7.2 ks, respectively. As is clear from the figure, with sample A, naturally enough, the melting of the aluminum powder at around 660° C. was accompanied by an endothermic reaction, and when the temperature was further raised, the molten aluminum reacted with the titanium, which resulted in an exothermic reaction accompanying the generation of intermetallic compounds. With samples B and C, no endothermic reaction was seen to accompany the melting of the aluminum powder, but the generation of intermetallic compounds in the vicinity of 650° C. was seen to result in an exothermic reaction. Meanwhile, with samples D and E, these endothermic and exothermic reactions were not seen at all, confirming that the alloying of the titanium and aluminum proceeded extremely smoothly.

It can be seen from the above just how important holding the pressure for the specified duration during forming is in terms of achieving a high density in the resulting sintered body, and suppressing the generation of intermetallic compounds. It also readily apparent that suitable selection of the duration for which this pressure is held allows a higher density, and in turn superior strength and other characteristics, to be realized even when the targeted sintered body has a complex shape.

Since the above forming process was carried out in the atmosphere, the mixed powder raw material and the compact were subjected to oxygen analysis in order to examine the extent of oxidation of said mixed powder raw material during this forming. As a result, the amount of oxygen was 0.077% with the titanium powder and 0.724% with the aluminum powder, and the amount of oxygen in the compact was 0.171%. Therefore, the amount of oxygen introduced by oxidation during forming was 0.055%, which poses almost no problem, and it was therefore confirmed that the method of the present invention allows a highly active metal such as titanium to be formed in the atmosphere, which means that the process is extremely easy to control during the forming of the compact.

With the method for forming a titanium alloy by powder metallurgy of the present invention, even if the targeted compact has a complex shape, it is possible to apply the molding pressure almost evenly to the powder raw material, and in turn to the compact. Also, the generation of excessive local shear stress is effectively prevented, which allows for the easy forming of a compact with a complex shape, with no shear cracking, and with a almost uniform density distribution. In addition, a sintered body with higher strength and almost true density, in which the generation of various defects that can occur during sintering has been prevented as much as possible, can be obtained from this compact.

Therefore, the method for forming a titanium alloy by powder metallurgy of the present invention can be advantageously applied to the fields of titanium alloy components manufactured by forging, or titanium alloy components made by forging and machining in the past.

What is claimed is:

1. A method for forming a titanium alloy by powder metallurgy, which comprises the processes of mixing uniformly a powder of titanium or an alloy thereof with a powder of low-melting point metal or alloy thereof, injecting the mixture into a press forming die, then press forming them under heating to a temperature near and over the melting point of the low-melting point metal, or to a temperature between the liquidus and the solidus of the low-melting point alloy, or to a temperature near and over the liquidus to obtain the targeted compact, and subsequently holding this compact in the pressurized state for a specified period to cause the molten low-melting point metal or alloy to infiltrate into the powder grain boundary of the titanium or alloy thereof without causing the generation of intermetallic compounds thereof, and then sintering the compact thus obtained in an inert atmosphere or a vacuum to diffuse the titanium or alloy thereof and the low-melting point metal or alloy into each other and to make alloys of them.

2. A method for forming the titanium alloy by powder metallurgy as defined in claim 1, wherein the low-melting point metal or alloy is aluminum, tin, or an alloy of these.

3. A method for forming the titanium alloy by powder metallurgy as defined in claim 1 or 2, wherein the temperature near and over the melting point or the temperature near and over the liquidus is the melting point or a temperature up to 100° C. over the liquidus.

4. A method for forming the titanium alloy by powder metallurgy as defined in any of claim 1, wherein the compact is held in the pressurized state for at least 10 minutes at a pressure of 10 to 500 MPa.

5. A method for forming the titanium alloy by powder metallurgy as defined in any of claim 1, wherein the compact is sintered for at least 30 minutes at a temperature of at least 1000° C.

6. A method for forming the titanium alloy by powder metallurgy as defined in claim 2, wherein the compact is held in the pressurized state for at least 10 minutes at a pressure of 10 to 500 MPa.

7. A method for forming the titanium alloy by powder metallurgy as defined in claim 3, wherein the compact is held in the pressurized state for at least 10 minutes at a pressure of 10 to 500 MPa.

8. A method for forming the titanium alloy by powder metallurgy as defined in claim 2, wherein the compact is sintered for at least 30 minutes at a temperature of at least 1000° C.

9. A method for forming the titanium alloy by powder metallurgy as defined in claim 3, wherein the compact is sintered for at least 30 minutes at a temperature of at least 1000° C.

10. A method for forming the titanium alloy by powder metallurgy as defined in claim 4, wherein the compact is sintered for at least 30 minutes at a temperature of at least 1000° C.

11. A method for forming the titanium alloy by powder metallurgy as defined in claim 6, wherein the compact is sintered for at least 30 minutes at a temperature of at least 1000° C.

12. A method for forming the titanium alloy by powder metallurgy as defined in claim 7, wherein the compact is sintered for at least 30 minutes at a temperature of at least 1000° C.

* * * * *